US006338379B2

(12) United States Patent
Mantovan et al.

(10) Patent No.: US 6,338,379 B2
(45) Date of Patent: Jan. 15, 2002

(54) SLIDING CHAIN-TYPE INGOT MOLD FOR A CONTINUOUS CASTING PLANT

(75) Inventors: Gianfranco Mantovan, Busto Arsizio; Giuseppe Ferrario, Legnano, both of (IT)

(73) Assignee: Techint Compagnia Tecnica Internazionale S.p.A., Milan (IT)

( * ) Notice: Subject to any disclaimer, the term of this patent is extended or adjusted under 35 U.S.C. 154(b) by 0 days.

(21) Appl. No.: 09/741,341

(22) Filed: Dec. 21, 2000

Related U.S. Application Data

(62) Division of application No. 09/178,429, filed on Oct. 26, 1998, now Pat. No. 6,192,972.

(30) Foreign Application Priority Data

Oct. 28, 1997 (IT) ..... MI97A2416

(51) Int. Cl.[7] ..... B22D 11/06
(52) U.S. Cl. ..... 164/430; 164/442
(58) Field of Search ..... 164/430, 442, 164/479

(56) References Cited

U.S. PATENT DOCUMENTS 5,924,474 A * 7/1999 Luginbühl et al. ..... 164/430

FOREIGN PATENT DOCUMENTS

JP 0306053 * 12/1989 ..... 164/430

* cited by examiner

*Primary Examiner*—Nam Nguyen
*Assistant Examiner*—I.-H. Lin
(74) *Attorney, Agent, or Firm*—Oblon, Spivak, McClelland, Maier & Neustadt, P.C.

(57) ABSTRACT

An improved sliding chain-type ingot mold for a continuous casting plant, including two pairs of chains arranged in a closed ring system and configured to rotate in opposite directions, each pair including at least one of molding elements and shell-type elements which forms a closed mold, the two pairs of chains being arranged to wind up on respective sprockets, one pair having a first set of the at least one of molding elements and shell-type elements configured to interlock with a second set of the at least one of molding elements and shell-type elements on the other pair to form a cavity for receiving a molten material, external pressurizing rollers configured to act on the first and second sets of the plurality of at least one of molding elements and shell-type elements to detach and approach with each other, and fixed contrasting elements fixedly positioned to counteract the pressurizing rollers.

3 Claims, 9 Drawing Sheets

10
14
15
12
13
16
17
11
14
15
IV
IV
14
15
16
17
V
V
14
15

10
15
13
15
16
16
IV
V
17
17
IV
V
14
12
14
11

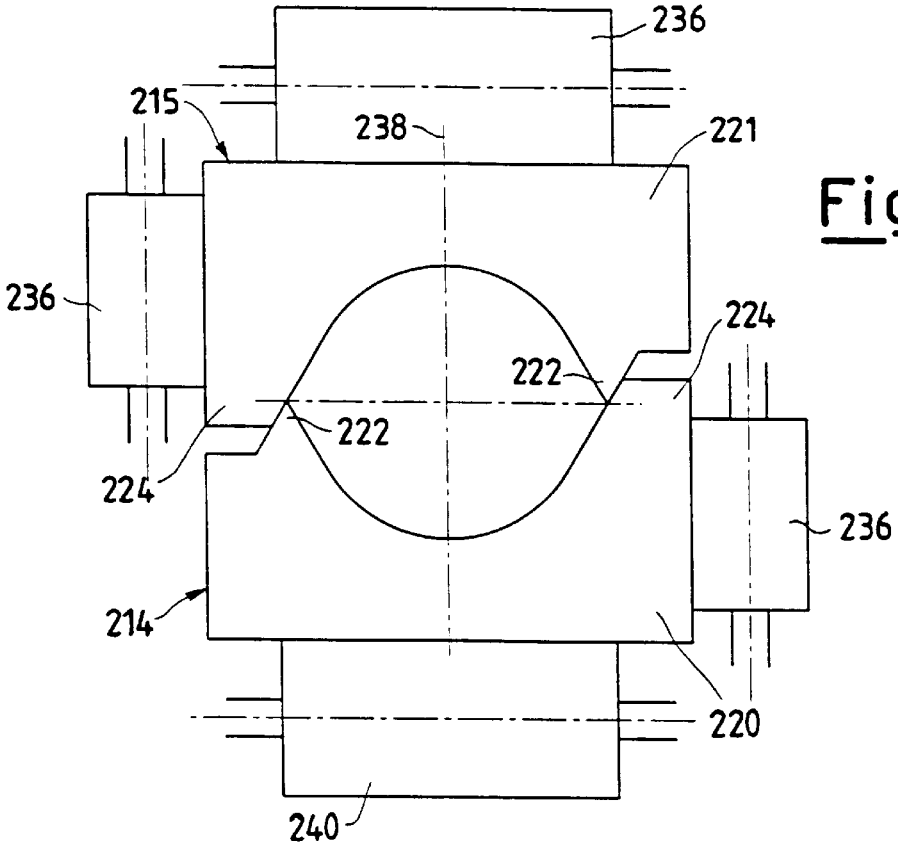
Fig.11
Fig.12
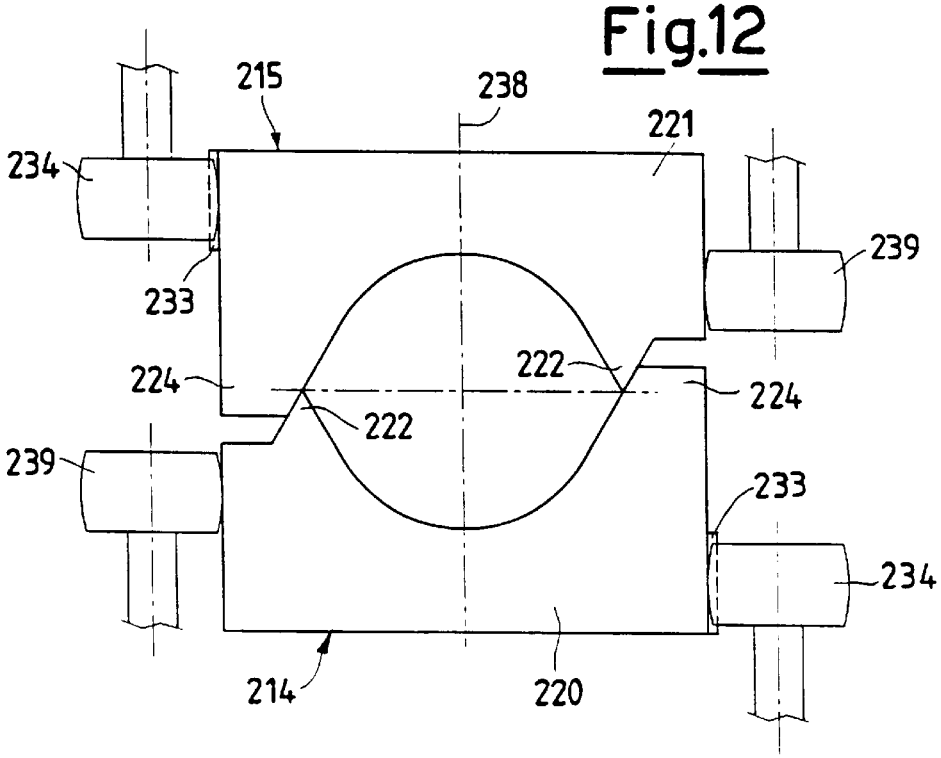

SLIDING CHAIN-TYPE INGOT MOLD FOR A CONTINUOUS CASTING PLANT

CROSS-REFERENCE TO RELATED APPLICATION

This application is a divisional application of Ser. No. 09/178,429, filed on Oct. 26, 1998 and now issued as U.S. Pat. No. 6,192,972.

BACKGROUND OF THE INVENTION

1. Field of the Invention

This invention refers to an improved sliding chain-type ingot mold for a continuous casting plant.

2. Description of the Background

The production of billets and ingots by a continuous casting process formerly utilized stationary mold or shell-type elements in which the steel coming from the ladle and basket was introduced. These plants have at in any case always suffered from considerable drawbacks, both from the viewpoint of productivity and of the difficulty of cooling the mold or shell-type elements.

It is in fact precisely the stationary structure of these mold or shell-type elements, being among other things of a limited longitudinal size, as well as the difficulties of maintaining contact between the solidified crust and the stationary structure, which allow only modest casting speeds, with a resulting slow and difficult heat dissipation from the mold or shell-type elements.

A solution was found in the production of trays capable of feeding several casting lines in parallel, all equipped with stationary mold or shell-type elements of the limited size mentioned above. However, even this solution involves some drawbacks, as any increase of the casting lines also causes an increase and a multiplication of the maintenance requirements and some heat dissipation problems.

Consequently, some plants have been developed which utilize a multiple number of mold or shell-type elements in motion, being firmly attached to two chains or crawler tracks arranged in a closed ring. These two chains arranged in a closed ring are over a straight portion of their path made to interface with each other, so as to generate a closed molding path to which the liquid metal coming from the trays can be directly fed.

Thanks to the lengthening of the longitudinal size of the closed mold, this system allows considerably boosting the casting speed, so as to attain the same productivity of three or four of the parallel lines described above. This also achieves the notable advantage of making it possible to operate directly in line with a subsequent rolling train or similar.

This type of continuous casting process, simply known as a sliding chain-type ingot mold, provides in particular, as mentioned, for two chains arranged in a closed ring, each carrying a multiple number of molding elements.

The molding elements can be made to interface with each other, so as to form a closed mold in the straight portion of the chain. In particular, in order to achieve this, a chain carries molding elements that are in one of their terminal portions capable of interlocking with the terminal portion of the molding elements carried by another chain. This produces a length of continuous cavity, formed in its interior by the interfacing and associated molds, in which the molten metal coming from the trays is cast.

Even this sliding chain-type ingot mold presents drawbacks and problems due to the deformations generated by the internal heat transmitted directly to the molten metal.

The deformations mainly cause a detachment of the two portions of the mold interfacing and associated with each other to form the cavity, with a resulting leakage of molten metal.

This also leads to a considerable reduction of the heat transmission, which overheats the copper structures designed to cool the interfacing molts, even up to the point of melting them.

Moreover, it is precisely because of these stresses that a deformation of the two interfacing molds occurs, causing slippages which lead to a rapid wastage of the same.

SUMMARY OF THE INVENTION

The main purpose of this invention is to solve the technical problems affecting the mentioned known art in an extremely simple, economical and particularly functional manner, while also eliminating the drawbacks outlined above.

Another purpose is to reduce to a minimum the wear of the parts involved and in reciprocal contact during the continuous casting process.

In view of these purposes and in accordance with the invention, it was conceived to produce an ingot mold of a sliding chain-type, capable of being employed in a continuous casting process, having the characteristics outlined in the attached claims.

BRIEF DESCRIPTION OF THE DRAWINGS

The structural and functional characteristics of this invention and its advantages with respect to the known art will become even clearer and more evident from an analysis of the following description, with reference to the enclosed drawings showing examples of an ingot mold according to this invention. In the drawings:

FIGS. 11 and 12 are two simplified cross sections of a fourth embodiment of the molding elements, capable of being positioned on the opposing chains of the ingot mold of this invention.

DESCRIPTION OF THE PREFERRED EMBODIMENTS

Figure 1:
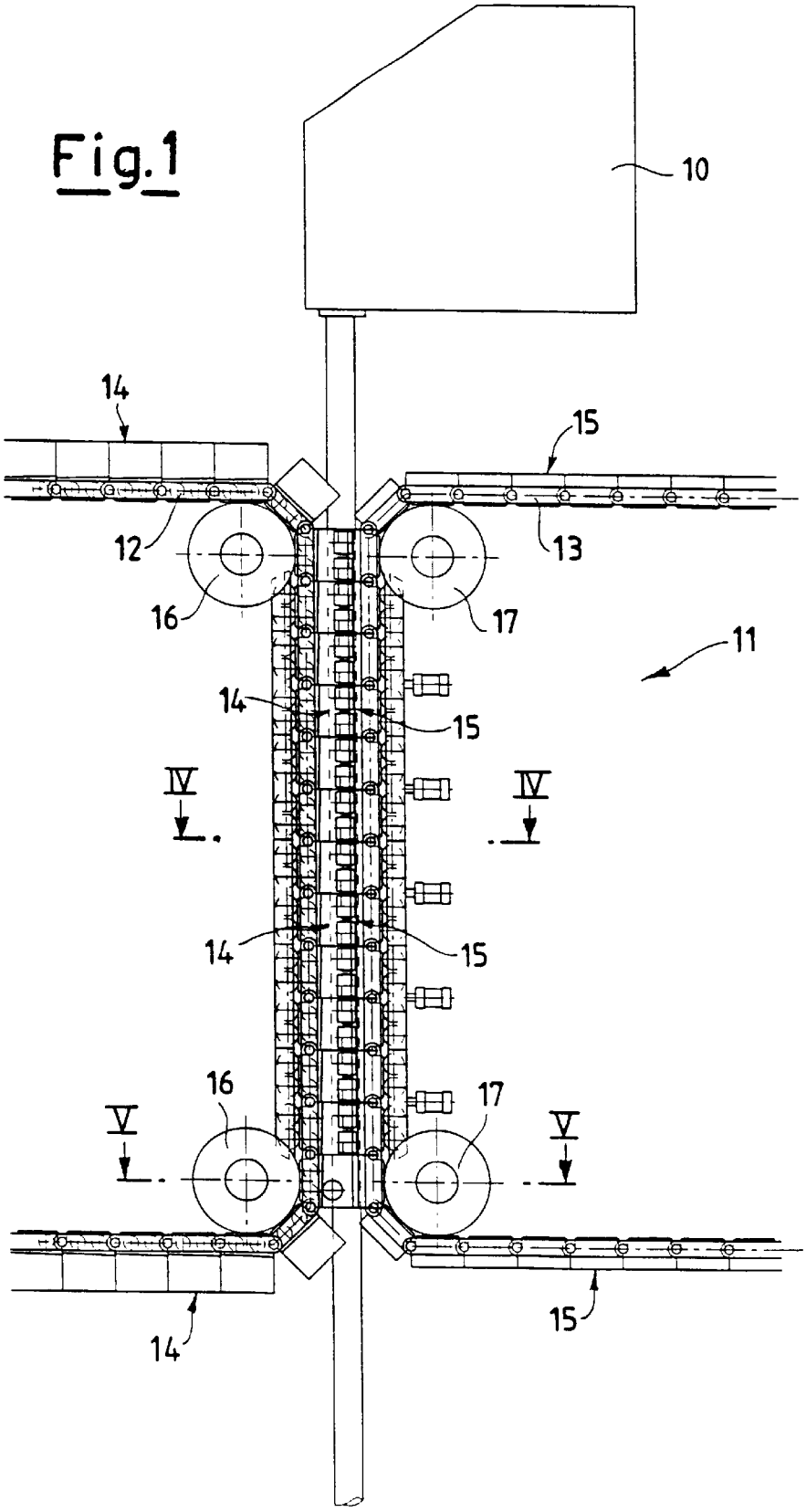
FIG. 1 is a view of part of a vertical, continuous casting plant equipped with a sliding chain-type ingot mold according to the invention.
Figure 2:
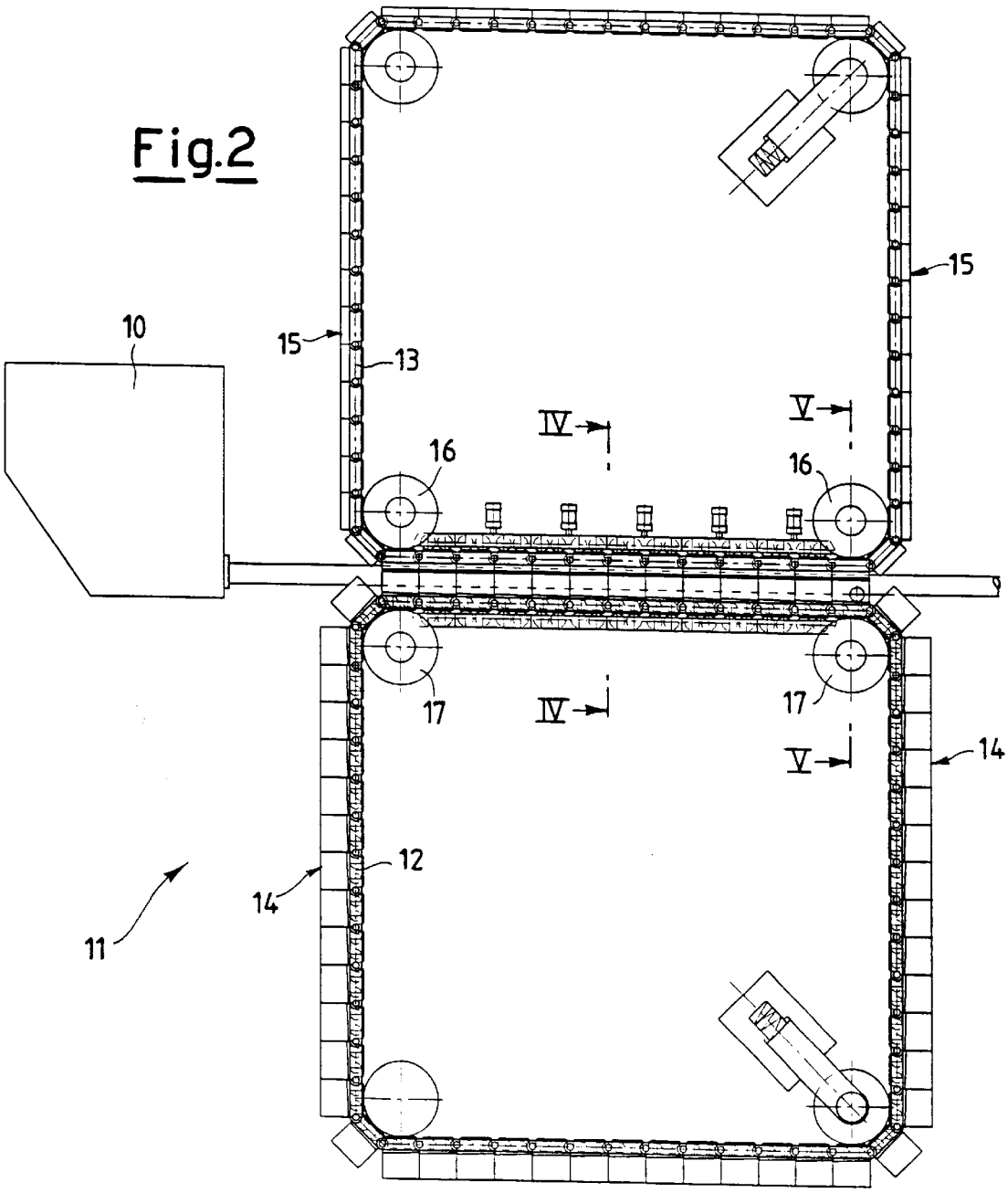
FIG. 2 is a view of part of a horizontal continuous casting plant equipped with a sliding chain-type ingot mold according to the invention.
Figure 3:
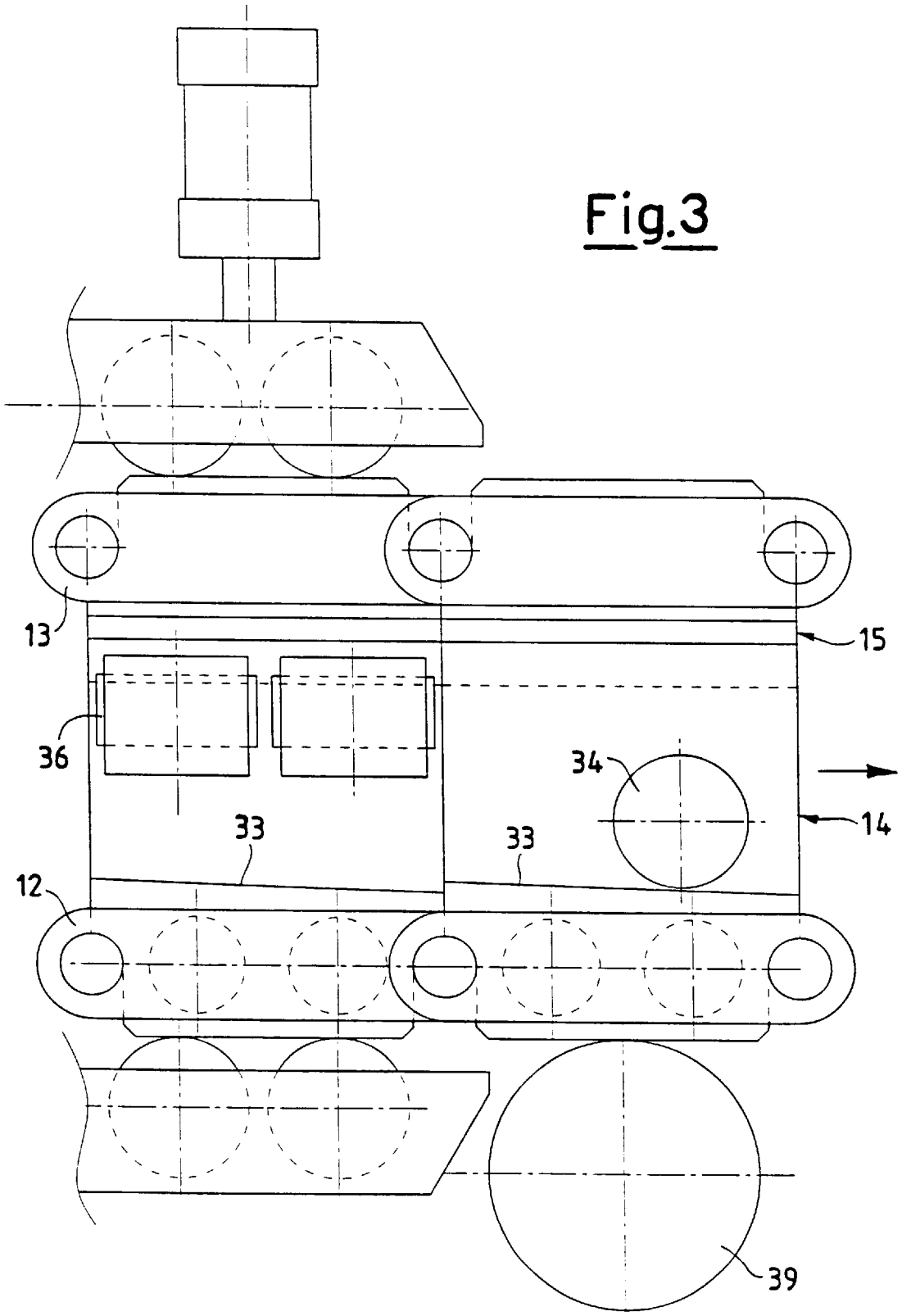
FIG. 3 is an enlarged raised side view of a detail of the two plants shown in FIG. 1 and/or 2, taken next to the end of the straight portion, before the gap between the molding elements interfacing with each other.

The FIGS. 1 and 2 show two continuous casting plants, one of a vertical and the other of a horizontal type, both equipped with a sliding chain-type ingot mold according to this invention.

The figures show a basket 10 feeding a dragging chain-type ingot mold, indicated in its overall form by 11.

The ingot mold 11 comprises two pairs of chains 12 and 13, both arranged in a closed ring, rotating in opposite directions and carrying a multiple number of molding or shell-type elements 14 and 15.

The molding or shell-type elements 14 and 15, forming two half-molds, can be made to interface with each other so as to form a closed mold. In particular, the two half molds are capable, when engaged with each other, of forming a cavity for the casting of metal.

The ingot mold 11 is in fact designed so that the two pairs of chains 12 and 13 are made to wind up on sprockets 16 and 17 which, in addition to causing the chains' forward motion, also define a straight portion of the ingot mold in which the two opposing half molds engage with each other so as to interlock and form a continuous cavity.

In order to achieve this, a pair of chains 13 carries some molding elements 15 fitted in a terminal portion with external surfaces 19 capable of inserting and engaging themselves in corresponding internal surfaces 18 of a terminal portion of the half-mold elements 14 carried by the other pair of chains 12. This produces a length of continuous cavity, formed internally by the half molds 14 and 15 interfacing and associating with each other, into which the molten metal coming from the tray 10 is directly cast.

Figure 4:
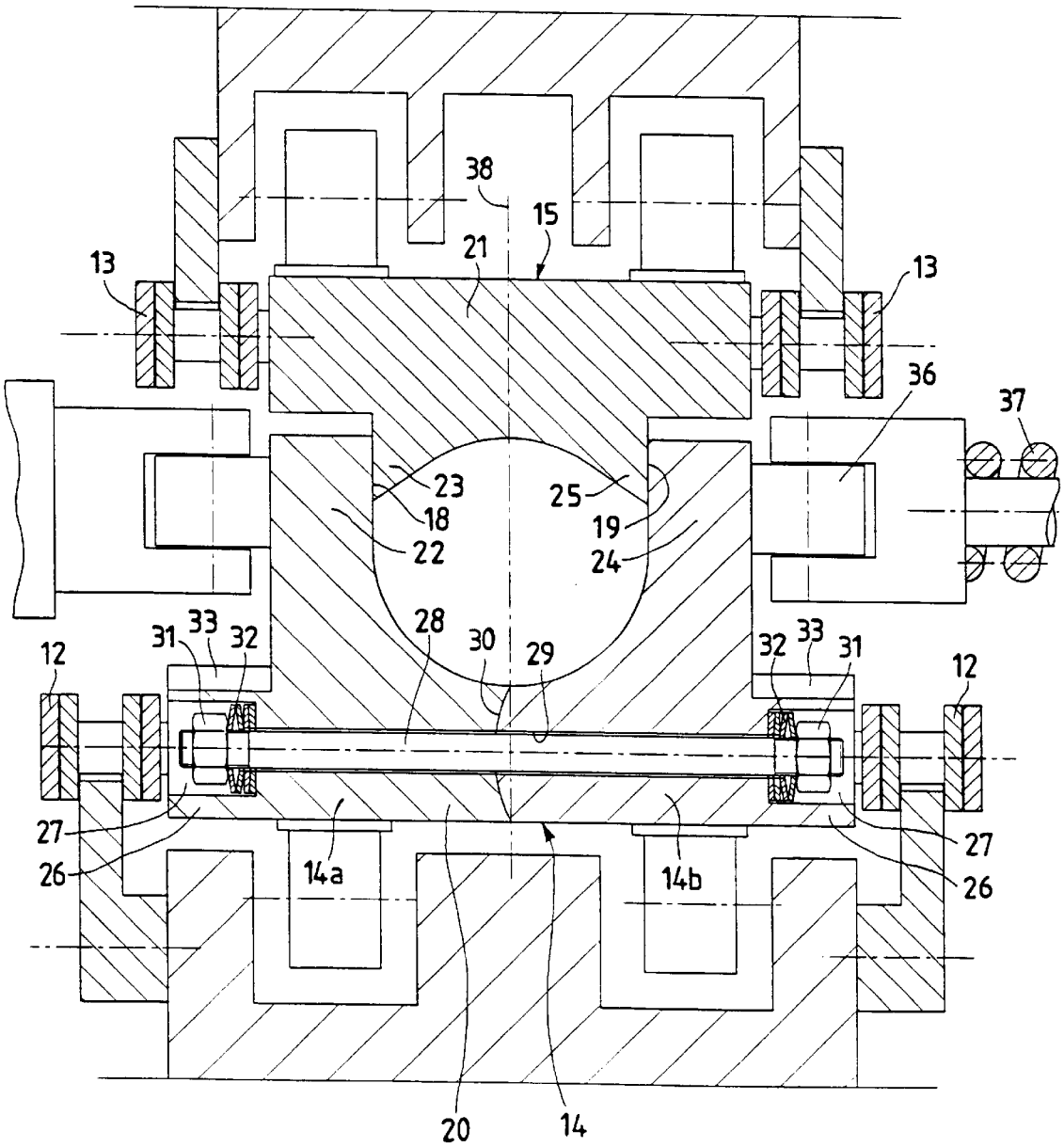
FIG. 4 is an enlarged transversal cross-section, taken along the line IV—IV of FIG. 1 and/or 2.
Figure 5:
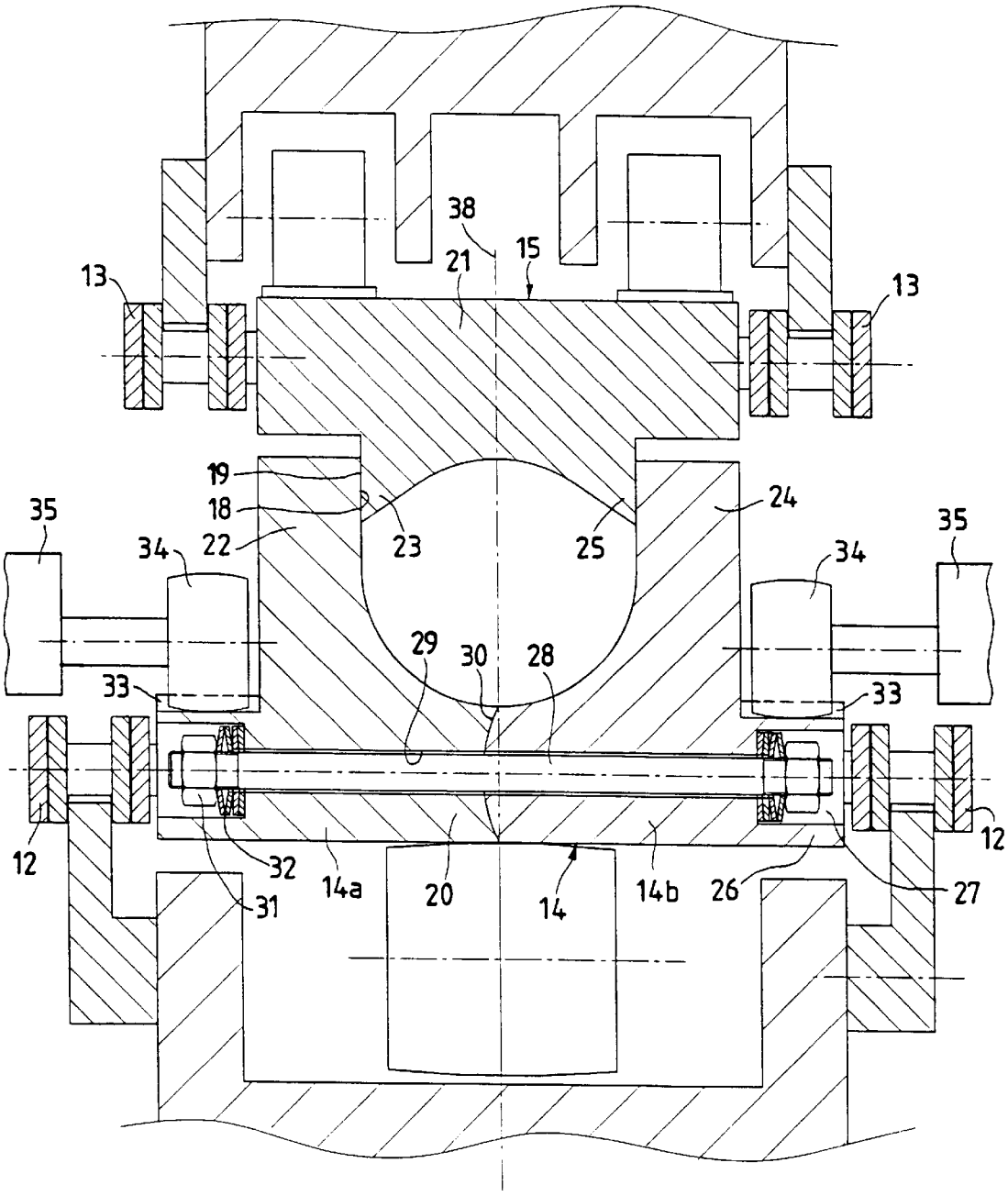
FIGS. 5 and 6 are enlarged transversal cross sections, taken along the line V—V of FIG. 1 and/or 2, showing the chain and the relative molding elements in two different positions of forward motion.
Figure 6:
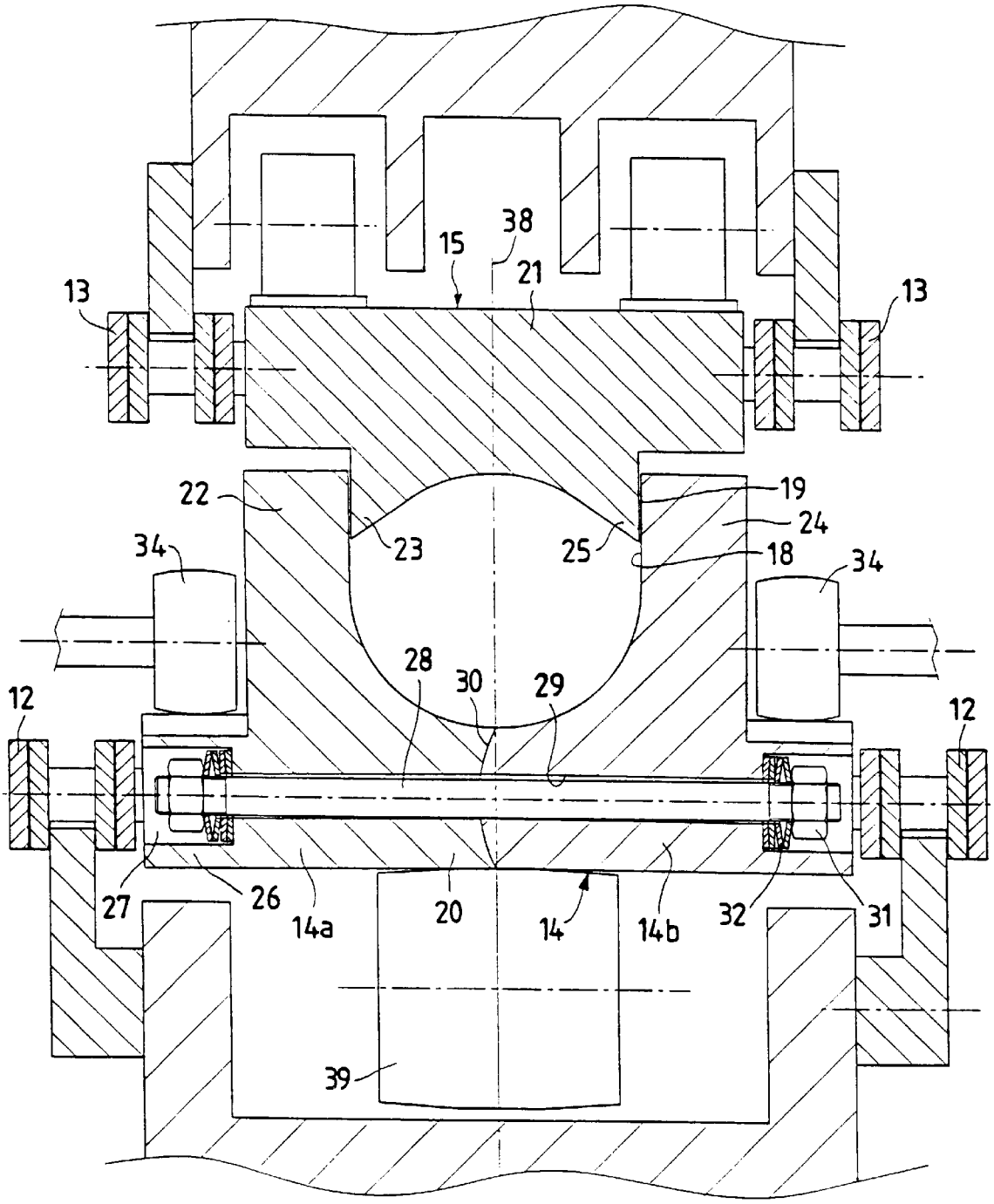

The molding elements 14 and 15, as shown in the cross sections of FIGS. 4–6, both comprise a base portion 20 and 21, each of which is projecting some leg-shaped walls 22, 24 and 23, 25, capable of forming a more or less pronounced, essentially U-shaped section.

The pair of chains 13 is arranged to the sides of the base portion 21, just as the pair of chains 12 is arranged to the sides of the base portion 20.

In this second case it is also worth noting that the base portion carries two lateral extensions 26, fitted with a hollow seat 27 housing a rod which also passes through a hole 29 in the base portion 20.

This arrangement produces a connecting element designed to maintain a firm bond between the two portions 14*a* and 14*b*, which constitute each molding element 14 of the embodiment shown. It can in particular be noted that these two portions 14*a* and 14*b* are coupled along opposing, rounded and complementary surfaces 30, around which the two portions 14*a* and 14*b* of the molding element 14 may oscillate in the way of a spherical coupling working in combination with an underlying barrel-shaped roller 39.

This oscillation is also possible because the two extremities of the rod 28 are fitted, between the locking nuts 31 and the hollow seats 27, with elastic elements such as cup-type springs or Belleville springs 32.

This arrangement guarantees contact but allows a slight reciprocal rotation. It is worth noting that the two molding elements 14 and 15 offer a symmetric shape with respect to an axis of symmetry 38 perpendicular to the two base portions 20 and 21.

The upper surfaces of the two lateral extensions 26 of the base portion 20 are further equipped with two cam-shaped surfaces 33. These cam-shaped surfaces are capable of contacting and interacting with some engaging elements constituted by a pair of rollers 34 in a fixed frame 35 at the extreme end of the straight portion of the ingot mold. The cam-shaped surfaces 33 are arranged along the longitudinal direction of motion of the two pairs of chains, and increase in height in the direction of their forward motion.

The straight portion of the ingot mold may provide for some rollers 36, which are always firmly attached to the fixed frame 35. These rollers 36, which are positioned from opposite sides on the external surfaces of the leg-shaped walls 22, 24 of the molding elements 14, form a lateral guide, thanks also to the presence of springs 37 capable of modulating their lateral pushing action.

Of course both sets of multiple molding elements 14 and 15 are equipped with their relative cooling facilities (not shown) as well as with some guiding elements along their entire path.

The operation of an arrangement according to this invention is as follows.

Some drive units, not shown, rotate the two pairs of chains 12 and 13 along with their respective molding elements 14 and 15.

When the liquid metal feed is started from the tray 10, this metal enters between the molding elements 14 and 15, which are associated to engage with each other and form a continuous cavity in motion along the straight portion of the two pairs of chains 12 and 13.

During the motion of the two pairs of chains 12 and 13 along with their relative molding elements 14 and 15 closed between them, the cavity is kept in a continuous and uniform condition also thanks to the presence of the rollers 36 acting on the external surfaces of the leg-shaped walls 22, 24 of the molding elements 14.

This produces a composite and continuous forward motion nearly up to the end of the straight portion, where each of the engaged molding elements 14 and 15 comes to be opened by the deviation of the two pairs of chains to which the molding elements are firmly attached.

It is in this phase that the cam surfaces 33 placed on the extensions 26 of the base portion 20 of each molding element 14 come to interact with the engaging elements constituted by the rollers 34. Since the cam-shaped surfaces 33 are rising in height in the direction of their forward motion, this generates, as shown in FIG. 6, a reciprocal rotation between the two portions 14*a* and 14*b* of the molding element 14. The entire process is obviously made possible, as shown above, by the presence of the two rounded surfaces 30 and the springs 32 placed on the extremities of the rod 28 and the underlying barrel-shaped roller that acts to counter the rotation.

This slight rotation causes a detachment between the internal surfaces 18 of the molding element 14 and the external surfaces 19 of the molding element 15 that facilitates their detachment.

This rotation also helps to prevent friction between the mentioned surfaces, and any undesirable deformations on the two molding elements.

This solves the problems of the known continuous casting plants, while eliminating the wear which boosts the number of repairs and the operating costs of the ingot mold.

Figure 7:
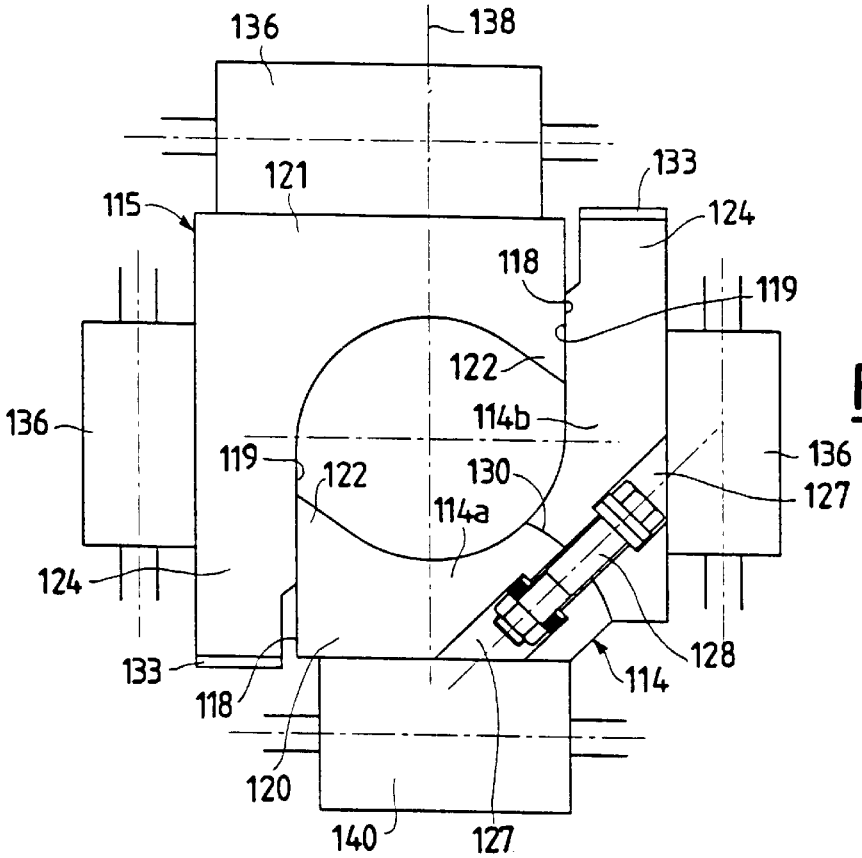
FIGS. 7 and 8 are two simplified cross sections of a second embodiment of the molding elements, capable of being positioned on the opposing chains of the ingot mold of this invention.
Figure 8:
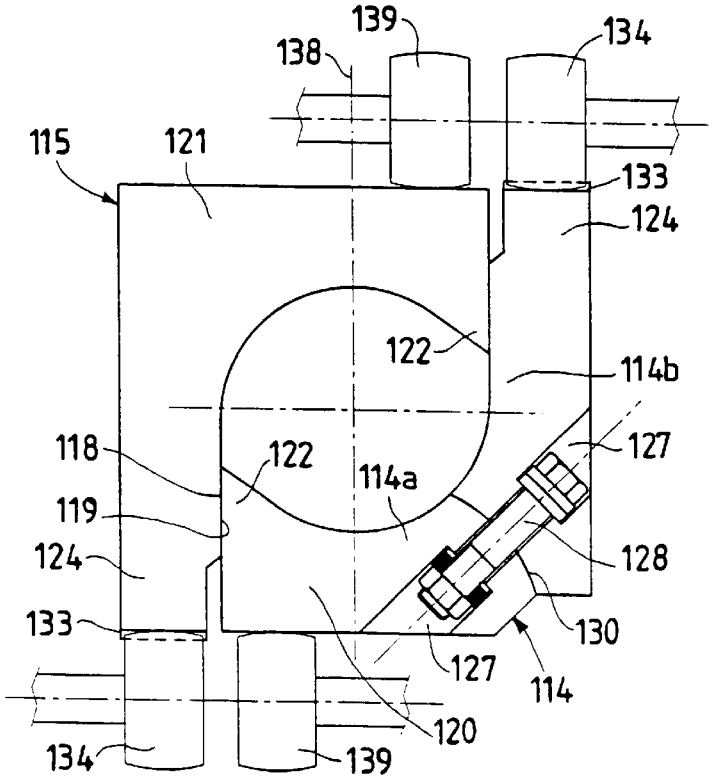

FIGS. 7 and 8 show a simplified alternative first embodiment of molding elements capable of being positioned on the pairs of chains while using various means of engagement.

In this embodiment the molding elements are generally produced, as shown before, one in a single piece and the other in two pieces. In this embodiment equal elements are designated by the same reference numbers as formerly used, preceded by the number "1".

Each lower molding element 114 is in fact produced in, two portions, indicated by 114*a* and 114*b*, and presents an asymmetrical shape with respect to an axis 138 set perpendicular to two base portions 120 and 121.

FIG. 7 shows a first transversal cross section where it can be seen that in the molding element 114 the base portion 120 constitutes the first portion 114*a*, which is fitted on one side with a pointed leg-type wall 122. The other side carries a rounded surface 130 facing a complementary rounded surface 130 of the second portion 114*b*. This second portion 114*b* extends on the other side into a vertical leg-type wall 124, similar to the previous walls 24, but arranged to the side of the upper base portion 121.

The molding section 115 is simply constituted by a molding element rather similar to the molding element 114, but is rotated in its arrangement by 180° with respect to the mentioned axis 138 of the mold, and produced from a single piece.

The internal surfaces of the leg-shaped wall 124 of the upper molding element 115 are set against the external surfaces 118 of the pointed leg-shaped wall 122 of the lower molding element 114, and the same applies on the other side to the same leg-shaped walls 124 and 122. It can be noted that the three pressurizing rollers 136 form lateral guides and a fixed lower roller 140.

A second cross section in FIG. 8 shows that there are two fixed upper and lower rollers 139 acting to counter the motion. There are also two upper and lower pressurizing rollers 134 which act on the cam-shaped surfaces 133 extending from the free extremities of the portion 114*b* of the lower molding element 114 and from the leg-shaped wall 124 of the upper molding element 115. The pressurizing rollers 134 act as external engaging elements.

This arrangement of the rollers promotes the detachment between the two molding elements 114 and 115, for example by forcibly oscillating the portion 114*b* around the rounded surfaces 130 and the upper molding element with respect to the fixed upper roller 139.

An arrangement based on an inclined rod 127 passing through some hollow seats 127 produces a connecting element designed to keep the two portions 114*a* and 114*b* tied up to each other even during the oscillation.

Figure 9:
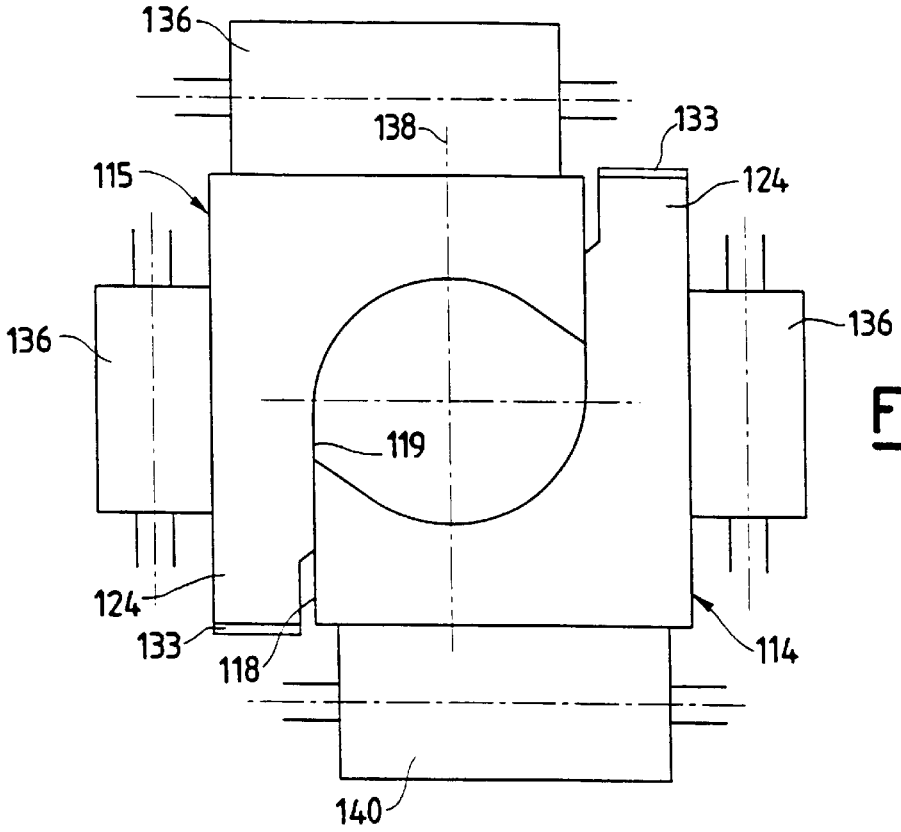
FIGS. 9 and 10 are two simplified cross sections of a third embodiment of the molding elements of the ingot mold of this invention, similar to that shown in FIGS. 7 and 8.
Figure 10:
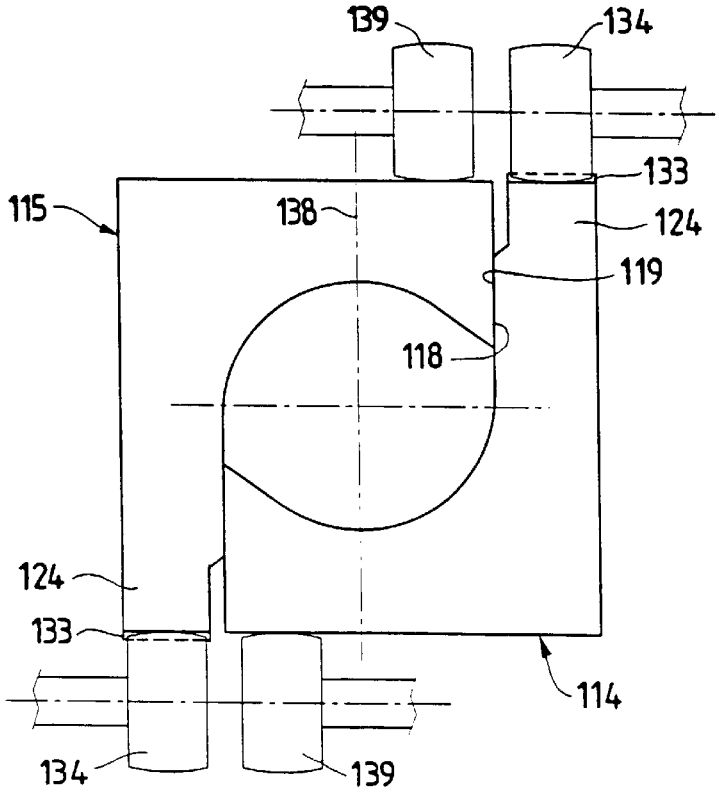

Two further cross sections in FIGS. 9 and 10 offer a simplified view of an alternative embodiment very similar to the one shown in FIGS. 7 and 8.

In this embodiment the molding elements 114 and 115 are both produced from a single piece, and there is no pair of rounded surfaces 130.

In this manner both the lower molding element 114 and the upper molding element 115 oscillate with respect to the two fixed lower and upper rollers 139, whenever the two upper and lower pressurizing rollers 134 act on the cam-type surface 133, if available, or by shifting the pressurizing rollers 134 with the aid of an appropriate actuator.

In a simplified manner, FIGS. 11 and 12 finally show a fourth alternative embodiment of some molding elements capable of being positioned on the pairs of chains.

Even in this embodiment, both molding elements are produced from a single piece, and equal elements are indicated by the same reference numbers preceded by the number "2".

A lower molding element 214 is produced from a single piece and presents an asymmetrical shape with respect to an axis 238 perpendicular to the two base portions 220 and 221. The upper molding element 215 is simply constituted by a molding element entirely similar to the lower molding element 214, but rotated in its arrangement by 180° with respect to the axis 238.

In the section shown in FIG. 11 it can be seen that the molding elements 114 and 115 have somewhat different forms of the leg-shaped walls 222 and 224 extending from the base portions 220 and 221, but the situation is entirely equivalent.

Even in this case there are three pressurizing rollers 236 forming lateral guides, and a fixed lower supporting roller 240.

A second cross section in FIG. 12 shows that there are two fixed lateral rollers 239 acting to counter the motion, and two further pressurizing rollers 234 acting on the opposing lateral cam-shaped surfaces 233 of the two molding elements 214 and 215, again if available, or being shifted by appropriate actuators not shown here. The pressurizing rollers 234 act as external engaging elements.

It is precisely this arrangement of rollers that promotes the detachment between the two molding elements 214 and 215, for instance by oscillating the molding elements with respect to the relative fixed roller 239.

This produces the same technical solutions which are the object of this invention.

It is obviously evident that there may be different arrangements of rollers and that the cam-shaped surfaces may be fixed to interact with the rollers, without abandoning the scope of protection of this invention.

This accomplishes the purpose mentioned in the introductory description. The embodiments may naturally differ from those shown for purely exemplifying and non-limiting purposes in the drawings, just as there can be different elements of reciprocal engagement capable of generating the forcible separation of the molding elements while eliminating harmful friction.

The scope of protection of the invention is in any case circumscribed by the enclosed claims.

What is claimed is:

1. An improved sliding chain-type ingot mold for a continuous casting plant comprising:

two pairs of chains arranged in a closed ring system and configured to rotate in opposite directions, the two pairs of chains each including a plurality of at least one of molding elements and shell-type elements which forms a closed mold, said two pairs of chains being arranged to wind up on a plurality of respective sprockets, one pair of said two pairs of chains having a first set of said plurality of at least one of molding elements and shell-type elements configured to interlock with a second set of said plurality of at least one of molding elements and shell-type elements provided on the other pair of said two pairs of chains to form a cavity for receiving a molten material;

a plurality of pressurizing rollers configured to act on said first and second sets of said plurality of at least one of molding elements and shell-type elements to detach and approach with each other; and a plurality of rollers fixedly positioned to counteract said plurality of pressurizing rollers.

2. An improved sliding chain-type ingot mold for a continuous casting plant comprising:

two pairs of chains arranged in a closed ring system and configured to rotate in opposite directions, the two pairs of chains each including a plurality of at least one of molding elements and shell-type elements which forms a closed mold, said two pairs of chains being arranged to wind up on a plurality of respective sprockets, one pair of said two pairs of chains having a first set of said plurality of at least one of molding elements and shell-type elements configured to interlock with a second set of said plurality of at least one of molding elements and shell-type elements provided on the other pair of said two pairs of chains to form a cavity for receiving a molten material;

a plurality of external pressurizing rollers configured to act on said first and second sets of said plurality of at least one of molding elements and shell-type elements to detach and approach with each other; and a plurality of fixed contrasting elements fixedly positioned to counteract said plurality of pressurizing rollers.

3. An improved sliding chain-type ingot mold for a continuous casting plant comprising:

two pairs of chains arranged in a closed ring system and configured to rotate in opposite directions, the two pairs of chains each including a plurality of at least one of molding elements and shell-type elements which forms a closed mold, said two pairs of chains being arranged to wind up on a plurality of respective sprockets, one pair of said two pairs of chains having a first set of said plurality of at least one of molding elements and shell-type elements configured to interlock with a second set of said plurality of at least one of molding elements and shell-type elements provided on the other pair of said two pairs of chains to form a cavity for receiving a molten material;

a plurality of external engaging elements configured to act on said first and second sets of said plurality of at least one of molding elements and shell-type elements to detach and approach with each other; and a plurality of rollers fixedly positioned to counteract said plurality of external engaging elements.

* * * * *